United States Patent [19]

Scharton et al.

[11] Patent Number: 4,699,665

[45] **Date of Patent: * Oct. 13, 1987**

[54] METHOD OF PRESSURE PULSE CLEANING HEAT EXCHANGER TUBES, UPPER TUBE SUPPORT PLATES AND OTHER AREAS IN A NUCLEAR STEAM GENERATOR AND OTHER TUBE BUNDLE HEAT EXCHANGERS

[75] Inventors: Terry D. Scharton, Santa Monica; George B. Taylor, Culver City, both of Calif.

[73] Assignee: Anco Engineers, Inc., Culver City, Calif.

[ * ] Notice: The portion of the term of this patent subsequent to Feb. 24, 2004 has been disclaimed.

[21] Appl. No.: 686,242

[22] Filed: Dec. 26, 1984

[51] Int. Cl.[4] ..... B08B 3/12; B08B 5/00; B08B 9/02

[52] U.S. Cl. ..... 134/1; 15/1; 134/17; 134/21; 134/22.12; 134/22.18; 134/37; 165/95; 376/316

[58] Field of Search ..... 15/316 R, 404, 406; 134/1-3, 22.12, 22.18, 37, 10, 17, 21; 376/310, 316; 165/95

[56] References Cited

U.S. PATENT DOCUMENTS

| | | | |
|---|---|---|---|
| 3,517,674 | 6/1970 | Allen et al. | 134/1 |
| 4,320,528 | 3/1982 | Scharton et al. | 376/310 |
| 4,366,003 | 12/1982 | Korte et al. | 165/95 X |
| 4,407,236 | 10/1983 | Schukei et al. | 165/95 X |

FOREIGN PATENT DOCUMENTS

| | | | |
|---|---|---|---|
| 926508 | 5/1982 | U.S.S.R. | 165/95 |

*Primary Examiner*—Richard V. Fisher
*Assistant Examiner*—W. Gary Jones
*Attorney, Agent, or Firm*—Thomas I. Rozsa

[57] ABSTRACT

The present invention relates to an improved method of cleaning a nuclear steam generator by removing the buildup of deposits which accumulate on the upper tube support plates, on the heat exchanger tubes, on flow holes in the support plates and between the support plates and heat exchanger tubes, and on other secondary side surfaces of a heat exchanger vessel through utilization of a repetitive shock wave induced in the deposits. The shock wave serves to effectively and safely loosen the products of corrosion and other elements which settle on these surfaces of the heat exchanger vessel and thereby facilitiates their easy removal through flushing and vacuuming the vessel. The shock waves are induced by air-gun type pressure pulse shock wave sources or pressurized gas-type pressure pulse shock wave sources.

24 Claims, 3 Drawing Figures

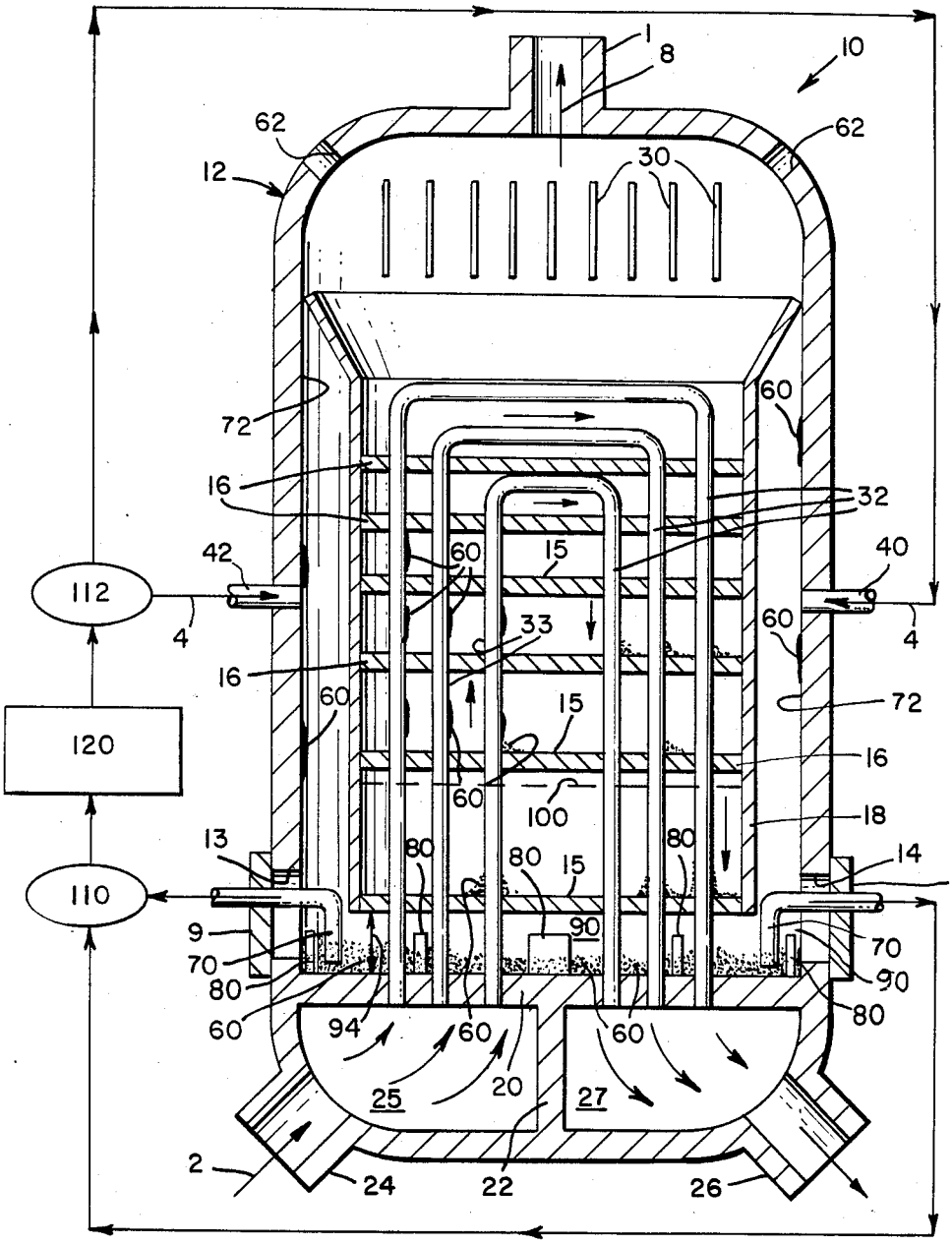
Fig. 1.
Fig. 2.
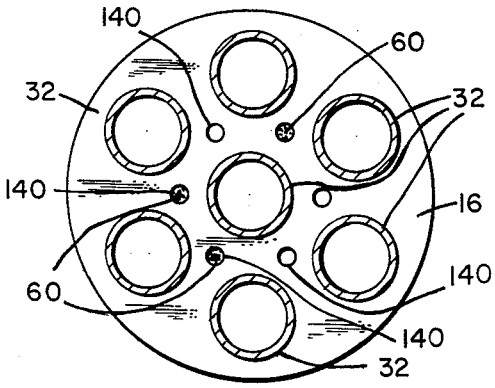
Fig. 3.
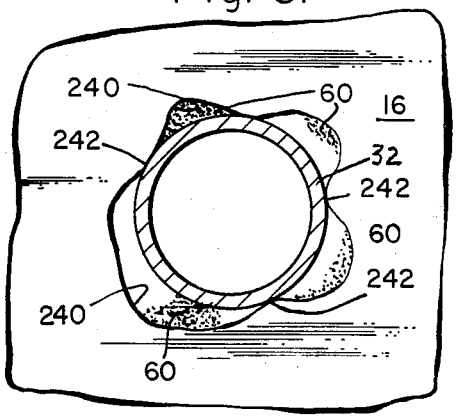

METHOD OF PRESSURE PULSE CLEANING HEAT EXCHANGER TUBES, UPPER TUBE SUPPORT PLATES AND OTHER AREAS IN A NUCLEAR STEAM GENERATOR AND OTHER TUBE BUNDLE HEAT EXCHANGERS

BACKGROUND OF THE INVENTION

1. Field of the Invention

The present invention relates to an improved method of cleaning a nuclear steam generator and other tube bundle heat exchangers by removing the buildup of sedimentation and other deposits which accumulate on the heat exchanger tubes, on the tube support plates at various elevations, and on other surfaces of the heat exchanger vessel through utilization of a repetitive shock wave induced in a liquid medium placed in the heat exchanger vessel. The repetitive shock wave serves to effectively and safely loosen the products of corrosion and other elements and thereby facilitates their easy removal through flushing and vacuuming the vessel.

2. Description of the Prior Art

One of the major components in a power generating facility such as a nuclear power plant is the steam generator or heat exchanger portion of the facility. Large scale heat exchanger systems are essentially comprised of a primary system which contains a large number of individual tubes which have fluid circulating through them and a secondary system which consists of a second fluid surrounding said tubes contained within a housing which enwraps both systems. Heat is transferred from the fluid running through these heat exchanger tubes to the fluid in the secondary system which is itself eventually turned to steam. The steam, in turn, generates power.

These heat exchangers or steam generators have experienced many problems due to the buildup of products of corrosion, oxidation, sedimentation and comparable chemical reactions within the heat exchanger. The problem of magnetite buildup at the junctions of the primary heat exchanger tubes and the support plates for those tubes, and further magnetite buildup within the crevices between the tubes and their support plates was extensively treated in U.S. Pat. No. 4,320,528. That patent addressed the use of ultrasonic methods to facilitate the removal of the magnetite from those junctions.

At the bottom of the heat exchanger vessel is a tube sheet. This thick metal plate which acts as the support base for numerous heat exchanger tubes is a primary support structure in the steam generator. In addition to the problems of magnetite buildup at the junctions and inside the crevices of the primary heat exchanger tubes and their support pltes, a second problem has also troubled steam generators for many years. There is a buildup of sedimentation of "sludge" which accumulates in the bottom of heat exchanger vessels. This sludge includes copper oxide, magnetite and other oxidation or corrosion products which have not adhered to the tubing or other surfaces and therefore accumulate at the bottom. The sludge pile rests on top of the tube sheet and may form a thick layer. The sludge further accumulates in the crevices between the tube sheet and the primary heat exchanger tubes which are embedded in the tube sheet for support. The problem of removing the sludge which enters the deep crevices in the tube sheet was addressed in presently pending patent application Ser. No. 06/370,826 filed on 4/22/82. Patent application Ser. No. 06/370,826 solves the problem of removing sludge from the deep crevices through use of specilaized ultrasonic waves which are directed in a certain way to produce the desired result. A method of removing the sludge on the lowermost tube support sheet through the use of pressure pulses was addressed in presently pending U.S. patent application Ser. No. 06/486,352 filed 4/19/83.

In addition to adhering on the tube support sheet, the sludge and other deposits also adhere to the interior of the heat exchanger tubes. A method of pressure pulse cleaning and removing sludge and other deposits from the interior of heat exchanger tubes is addressed in presently pending U.S. patent application Ser. No. 06/604,048 filed 4/26/84.

In addition to the above problems which have been addressed by the above referenced patent and patent applications, corrosion byproducts deposit on the exterior surfaces of heat exchanger tubes and on the tube support plates as well as on the interior sides of the heat exchanger vessel. These deposits, which are commonly found in the upper region of the steam generator, can restrict the water flow in the heat exchange process and also accelerate corrosion of the tube support plates, the heat exchanger, and the metal walls of the heat exchanger vessel.

The buildup of sludge on the tube support plates and the heat exchanger tubes degrades the heat transfer process from the fluid in the primary system to the fluid in the secondary system, and may also restrict secondary fluid flow. The heat exchanger tubes can also be damaged. As a result, it is very important to clean the heat exchanger or steam generator to effectively remove the sludge from the surface of the tube support plates, the heat exchanger tubes, and other surfaces such as the walls of the heat exchanger vessel. Much of the prior art referenced in the previous patent and patent applications employs the use of ultrasonics. While the methods discussed are effective and valuable, the use of ultrasonics has several disadvantages. First, in order to generate the ultrasonic waves, expensive transducers must be used. This requires considerable effort and expense to bring the ultrasonic transducers to the site of the steam generator and then putting them in their proper place at the location of or within the steam generator. Second, in order to achieve an effective level of ultrasonic waves, it is often necessary to cut away a portion of the steam generator wall and put the face of the transducer at the location of the cut away portion. Many owners of the power plants which incorporate a steam generator are reluctant to have a portion of a wall cut away and then later welded back in place after the steam generator has been cleaned.

A third problem which arises with prior art applications is the use of corrosive chemicals to assist in the cleaning operation. While the chemicals serve to clean and remove the sludge, they also serve to eat away at the various components of the steam generator. Therefore, it is desirable to find a method of cleaning which does not require the use of corrosive chemicals. One method known in the prior art is called water lancing. This is in effect the use of a jet of water which is shot into the sludge pile for the purpose of loosening the sludge. The results so far have not been very encouraging. The loosening process is not very effective and in addition there may be a problem of using the jet of water to impinge against the heat exchanger tubes at that location. The jet of water might cause sludge particles to reflect onto and then off the heat exchanger tubes, thereby possibly resulting in damage to these tubes. In addition, the technique of water lancing is not useful for removing sludge and deposits from the tube support plates, tubes and other surfaces above the tube sheet because the access to these regions is very limited. Also in many steam generator designs there is not even sufficient access to utilize water lancing on the bottom tube sheet. The close crowding of a large multiplicity of tubes and the high elevation make this method ineffective.

Therefore, although the use of ultrasonics combined with chemicals and the use of a jet of water are all known in the prior art for cleaning and removing sludge at the bottom of a heat exchanger or steam generator, none of these methods can be employed without the significant problems discussed above. The methods are also not effective in the upper regions of the steam generator due to the restricted available space.

Methods of pressure pulse cleaning have been addressed for cleaning the tube support plate and for cleaning the interior of heat exchanger tubes but no effective method has been previously discussed for cleaning the tube support plates, the exterior surfaces of heat exchanger tubes, and other heat exchanger surfaces such as the walls of the heat exchanger vessel without the use of ultrasonics and corrosive chemicals. Pressure pulse cleaning has not been discussed for removing sludge from these additional and critical areas of the steam generator vessel.

SUMMARY OF THE PRESENT INVENTION

The present invention relates to an improved method of cleaning a nuclear steam generator by removing the buildup of deposits which accumulate on the upper tube support plates, on the heat exchanger tubes, on flow holes in the support plates and between the support plates and heat exchange tubes and on other secondary side surfaces of a heat exchanger vessel through utilization of a repetitive shock wave induced in the deposits. The shock wave serves to effectively and safely loosen the products of corrosion and other elements which settle on these surfaces of the heat exchanger vessel and thereby facilitates their easy removal through flushing and vacuuming the vessel.

It has been discovered, according to the present invention, that if a source of high energy is used to generate a shock wave or pressure pulse which is directed into a water filled vessel, the shock wave and water surface fluctuations will impinge upon the unwanted deposits, agitate them, and thus cause the deposits to remain in suspension in the water medium or alternatively fall down to the tube sheet at the lower end of the vessel, from which they may be removed by a subseuent water flushing and vacuuming operation.

It has also been discovered, according to the present invention, that the use of a spherical shock wave to loosen the deposits permits the operation to be effectively achieved without the use of corrosive chemicals which might damage the components of the steam generator or heat exchanger.

It has additionally been discovered, according to the present invention, that the water level changes induced by releasing a burst of pressurized gas under the water surface may be used to clean surfaces washed and impacted by the water surface fluctuations. Thus the tube support plates of a steam generator may be cleaned by positioning the water level just below the support plates and through repeated release of pressure pulses causing the water surface to repetedly impact and wash the support plates. This washing and impact effect may also be used to clean the exterior surfaces of heat exchanger tubes and the side walls of the heat exchanger vessel.

It has also been discovered, according to the present invention, that the use of a pressure pulse or shock wave can also be used in conjunction with chemical solvents, if desired, to remove heavily encrusted materials such as magnetite from various locations within the steam generator.

It is therefore an object of the present invention to provide a method for quickly and efficiently loosening the products of oxidation and corrosion which settle on top of the tube support plates located at various elevations in the steam generator, on the external surface of the heat exchanger tubes, and on other surfaces of the steam generator.

It is another object of the present inventin to have a method for providing such pressure pulses or spherical shock waves which can be utilized with existing nuclear steam generator facilities and which will not require the cutting away of steam generator walls to fit the pressure source into the vessel wall.

It is another object of the present invention to provide a method of cleaning the sludge pile which rests on the tube support plates through the use of a process which can be used without corrosive chemicals but which also can be used in conjunction with corrosive chemicals if desired.

It is a further object of the present invention to provide a method for cleaning the steam generator which can use either an air source, a water source or an electrical source for generating the pressure pulse and water surface fluctuations, to agitate and loosen the deposits and keep them in suspension.

Further novel features and other objects of the present invention will become apparent from the following detailed description, discussion and the appended claims taken in conjunction with the drawings.

DRAWING SUMMARY

Referring particularly to the drawings for the purpose of illustration only and not limitation, there is illustrated:

FIG. 1 is a side sectional view of a typical heat exchanger or steam generator which contains a tube bundle through which the primary fluid is circulted.

FIG. 2 is a cross-sectional view taken across one type of heat exchanger and looking down on a tube support plate with heat exchanger tubes supported therein.

FIG. 3 is a partial cross sectional view taken across an alternative embodiment of a heat exchanger and looking down on a portion of a tube support plate encircling a heat exchanger tube.

DETAILED DESCRIPTION OF THE PREFERRED EMBODIMENT

Although the method of the present invention will now be described with reference to specific embodiments in the drawings, it should be understood that such embodiments are by way of example only and merely illustrative of but a small number of the many possible specific embodiments which can represent applications of the principals of the invention. Various changes and modifications obvious to one skilled in the art to which the invention pertains are deemed to be within the spirit, scope and contemplation of the invention as further defined in the appended claims.

With reference to the drawings of the invention in detail and more particularly to FIG. 1, there is shown as 10 a heat exchanger or steam generator. The external shell or envelope 12 of said steam generator 10 is a pressure vessel. In this external shall 12 are a large number of heat exchanger tubes 32. At the base of the heat exchanger tubes 32 is the support tube sheet 20. Along the length of the steam generator tubes 32 are support plates 16 which encircle each primary heat exchanger tube 32 so as to form a means for separating one tube from the next and allowing each tube to remain in a fixed position within the tube bundle. The heat exchanger tubes 32 and the support plates 16 are contained within a cylindrical iron wrapper 18. This cylindrical iron wrapper 18 runs the length of the steam generator 10 and termintes at its lower point just above the tube sheet 20.

At the base of the steam generator 10 is a primary entrance nozzle 24 which leads to the entrance chamber 25 located directly below the tube sheet 20. On the opposite side of the heat exchanger 10 is the exit chamber 27 and the primary exit nozzle 26. The exit nozzle is also located directly below the tube sheet 20. The entrance chamber 25 and the exit chamber 27 are separated by a metal wall 22.

Initially, a secondary fluid 4 enters the heat exchanger or steam generator 10 through secondary entrance inlets 42 and 40 located in the external shell 12. The secondary fluid 4 fills the steam generator 10 and surrounds the heat exchanger tubes 32.

The secondary fluid 4 goes under the metal wrapper 18 and then circulates up into the upper levels of the heat exchanger 10 through openings between the tightly packed heat exchanger tubes 32. Two alternative types of openings through which the secondary fluid can rise in the heat exchanger are shown in FIGS. 2 and 3. FIG. 2 is a cross-sectional view taken across one type of heat exchanger and looking down on a tube support plate 16 with heat exchanger tubes 32 supported therein. The heat exchanger tubes 32 are very tightly packed together and as a result any water seepage between them would be minimal. For example, there can be 16,000 tubes inside a heat exchanger. Therefore, a multiplicity of flow holes or blowdown holes 140 are placed into each tube support plate 16. Secondary side fluid such as water 4 flows up inside the heat exchanger vessel through the flow holes or blowdown holes 140. FIG. 3 is a partial cross-sectional view taken across an alternative embodiment of a heat exchanger and looking down on a portion of a tube support plate 16 encircling a heat exchanger tube 32. Due to the fact that the opening 240 in the tube support plate 16 is not perfectly round, there are places known as lands 242 where the heat exchanger tube 32 and the tube support plate 16 touch each other. The heat exchanger tube 32 is supported in the tube support plate 16 at the lands 242. The openings 240 serve as broached flow holes or blowdown holes to permit secondary fluid 4 to circulate and rise into the upper levels of the tube support plates 16. In the event these flow holes become clogged with deposits, a decrease in fluid flow rate results due to the back pressure created by the clogged flow holes.

In normal operation, the primary fluid 2 comes from a heat source such as nuclear reactor and enters said steam generator 10 through the primary entrance nozzle 24. The fluid enters into the entrance chamber 25 and is forced through the heat exchanger tubes 32 and up through the steam generator or heat exchanger 10. The heat exchanger 10 illustrated in FIG. 1 is of the U-bend type, where the primary heat exchanger tubes 32 run most of the length of the steam generator or heat exchanger 10 and are bent at the top of form a U-shaped configuration. Upon reaching the uppermost portion of the primary heat exchanger tubes 32, the primary fluid 2 starts back down the opposite side of the primary heat exchanger tubes 32, goes into the exit chamber 27 and exits the heat exchanger 10 through primary outlet nozzle 26.

Heat which is carried by the primary fluid 2 is transferred to the secondary fluid 4 while the primary fluid 2 is circulating through heat exchanger tubes 32. Sufficient heat is transferred to the secondary fluid 4 so that the primary fluid 2 leaving the exit nozzle 26 is at a substantially lower temperature than it was when it entered the heat exchanger through entrance nozzle 24. The secondary fluid 4 absorbs heat carried by the primary fluid 2 and said secondary fluid 4 becomes steam 8 during the heat absorbtion process. Said steam 8 passes through separators 30 which remove excess moisture from said steam 8, and then exits through steam outlet 1 at the top of the heat exchanger or steam generator 10. The high pressure steam 8 can then be used to drive a turbine.

The primary fluid 2 can be water. A gas such as helium or another liquid such as liquid sodium can also be used for the primary fluid. The secondary fluid is usually water.

During the process described above, a large amount of moisture and heat is generated within the steam generator 10. This leads to corrosion of various portions of the steam generator 10. Some of the corrosion remains on the metal, especially at the juncture of the primary heat exchanger tubes 32 and their support plates 16. These deposits also occlude the flow holes. Some of the corrosion deposits adhere to the walls 33 of the heat exchanger tubes 32 or adhere to other surfaces of the heat exchanger vessel such as the internal heat exchanger walls 72. Some of the corrosion and other chemical reactions do not remain on the metal surfaces but instead trickle down and settle on the upper tube support plates 16 or on the tube support sheet 20. The corrosive deposits 60 are shown adhering to these various surfaces or occluding the flow holes. The deposits such as sludge can include copper oxides, magnetite, and other oxidation and corrosion products which have a very detrimental effect on the components to which they have adhered. The presence of the corrosive deposits 60 affects the rate of flow of the secondry fluid 4 and also degrades the heat transfer process from the fluid in the primary system to the fluid in the secondary system. As more and more deposits adhere to the tube support plates 16, the heat exchanger tubes 20, the surfaces 72, within flow holes 140 or 240, and other important steam generator components, the vessel becomes only marginally useful as heat exchanger.

It is therefore the primary desire of the present invention to create a method of removing the corrosive deposits 60 which does not require the use of ultrasonics and their associated transducers. The general idea of the present invention is to use an "air gun" device to clean and remove the corrosion deposits from a nuclear power plant steam generator or other tube bundle heat exchanger. The concept is to induce a repetitive shock wave within the corrosive deposits 60 and within a liquid medium either surrounding or adjacent to the corrosive deposits, to thereby provide agitation which will loosen the corrosive deposits 60 and permit the deposits to either remain in suspension in the liquid medium or settle at lower elevations of the steam generators from which suspension or area they may be removed through a subsequent vacuuming operating.

In one alternative embodiment, sonic air guns, designated as 80, which are located below a water level 100, in the downcomer region 90 above the tube sheet 20 may be used to remove deposits 60 from the tube support plates 16. Typically, these deposits 60 sit on top of the support plate 16 ligaments, are encrusted in the gap 240 between the support plate ligament 16 and the heat exchanger tubes 32, are occluding one or more flow holes 140 or 240, or are attached to the heat exchanger tubes 16. When they occlude flow holes, these corrosive deposits 60 may inhibit flow causing unnecessary pressure drops through the support plates 16. The deposits 60 also accelerate corrosion on the surfaces to which they have adhered.

The present invention will first be described with respect to the process for cleaning corrosion deposits 60 from the support plates 16 and from the flow holes 140 or 240. The steam generator 10 is filled with a fluid such as water 4. The water 4 can be inserted through nozzles 40 and 42 and also inlet and outlet openings 24 and 26. In the preferred method, the water level is raised to a level just below the upper surface 15 of support plates 16, within the thickness of support plate 16, or alterntively just below the entire support plate 16.

Typically, the corrosive deposits 60 which for example can be sludge, consists of a layer which can be a fraction of an inch to several inches of loose iron and copper metals and oxides of granular structure which is comparable to loose sand. One application of the present invention is to use an air gun consisting of a high pressure air source which for example can be 2000 psi, modulated by a sharp rise-time value at a repetition of one Hertz to repeatedly introduce shock waves and pressure pulse fluctuations into the deposit of corrosive elements. The repetitive shock waves will loosen the corrosive deposits and move it into suspension in the liquid medium through which the shock waves have been sent or permit the elements to fall to lower levels in the steam generator. In another embodiment, the level of water is adjusted to a level several inches above the support plate to be cleaned and then the shock wave is introduced into the water or other fluid 4 which transmits the shock wave to the pile of corrosive deposits 60 resting on the support plate 16. In a third embodiment of the present invention, the level of water is adjusted to be initially at a level just above the tube support plate and the fluid level is lowered abruptly when the shock wave is in operation, to cause a further shock to the pile of corrosive deposits 60 resting on the support plate 16 or within flow holes 140 or 240. Alternatively, the level is initially just below the support plate and abruptly raised to a level just above the support plates. Fluid level changes between approximately 0.1 and 10 inches per second are required for cleaning., An ultrasonic wave which was used in prior art applications is a wave of high frequency whose primary purpose was to induce cavitation. The high frequency ultrasonic waves have short wave-lengths, low amplitudes and therefore low energy. In contrast, the concept of the present invention is to use a pressure pulse shock wave which is generated from a very intense and powerful output source and is frequently repeated. The spherical shock wave which is thereby produced is of lower frequency but of much higher energy which therefore can create a larger wavelength and a correspondingly larger movement on objects which it impacts.

Having thus described the concept of the present invention, one embodiment to produce the above result is illustrated in FIG. 1. In most embodiments, the outer shell 12 of the steam generator 10 has a series of small holes which are known as "hand holes" located near its lower portion and near the support tube sheet 20. These holes can be anywhere from approximately 1 to 6 inches in diameter. Two such holes are shown at 13 and 14 in FIG. 1. It will be appreciated that a conventional steam generator 10 may contain any multiplicity of such holes which are located around the circumference of outer shell 12 or else can be located in several vertical rows along the outer shell. While only two such holes 13 and 14 are shown in FIG. 1, it will be appreciated that any multiplicity of such holes can be located around the circumference of the steam generator 10 in one or more vertical rows.

A pressure pulse shock wave source 80 can be fit directly through a hand hole 13 or 14 and permitted to rest on or just above the tube support sheet 20. Each hand hole 13 and 14 is covered by a cap; 9 for hand hole 13 and 11 for hand hole 14 as shown in FIG. 1. The caps 9 and 11 serve to seal the opening and prevent fluid leakage. In addition, pressure pulse shock waves sources 80 of sufficiently small size can also be placed in the downcomer region 90 of the steam generator 10. The downcomer region 90 is located between the external shell 12 and the wrapper 18 which encircles the heat exchanger tubes 16. The pressure pulse shock wave source 80 can be inserted through an opening 62 in the external shell 12 such as a hand hole or manway, or through nozzle 42 or 40, and then lowered to a suitable location within the downcomer 90. In the preferred embodiment, the pressure pulse shock wave source 80 is lowered to a level just above the tube support sheet 20 so that the sonic waves can be transmitted through the open region 94 between the tube support sheet 20 and the metal wrapper 18.

The preferred method for removing the corrosive deposits from the top 15 of the tube support sheets 16 and from flow holes 14 and 240 is as follows. As previously described, a liquid such as water 4 is placed into the steam generator and is raised to a level slightly below the tube support plates 16 to be cleaned. A multiplicity of pressure pulse shock wave sources 80 is placed into the steam generator 10 in the region of the downcomer 90 and other pressure pulse shock wave sources 80 are placed into an associated one hand hole, 13 or 14. The liquid such as water 4 is placed into the steam generator 10 to the desired level through inlets 40 and 42 and permitted to rise to the desired level through the flow holes.

The pressure pulse shock wave sources 80 are then activated and a repeated pulsing operation causes a rapid release of pressurized gas to cause the water surface to slap the support plates 16. The pressure pulse shock wave sources 80 pressure generating faces should be submerged at least 12 inches below the level of the water in order to achieve the required level of pressure pulse "slap". After a period of an hour or more, this water slapping effect will loosen and remove deposits from the steam generator surfaces located at elevations near the water surface level. The deposits which are loosened then either flow into suspension in the water 4 or fall to lower areas of the steam generator 10. Bubbles created by the pressure pulses further assist in causing the loosened particles to remain in suspension. There is additional circulation of water due to the rising bubbles from the sources of shock waves. This creates more circulation and permits the sediment and deposits 60 to remain in suspension longer until they are pumped out by the filtration process to be described. In general, the bubbles carry water like a pump. The deposits can then be removed from the steam generator by water recirculating and jetting. By way of example, a filtration circulation system consisting of pumps 110 and 112 connected to filter 120 can be used. The water 4 containing the deposits 60 is flushed out of the steam generator through one or more suction nozzles such as 70 and 70 which were inserted through hand holes 13 and 14 respectively and rest near the tube sheet 20, pumped out by pump 110, run through the cleaning filter 120, and then recirculated back into the steam generator through inlets 40 and 42 by pump 112. In addition, the water initially positioned just below the tube support plate can subsequently be slowly raised to just below the upper surface 15 of the tube support plates 16 to be cleaned while the pulsing process continues to create water slapping. Alternatively, the water level can be initially positioned just above the level of tube support plate and flow holes to be cleaned and continuously lowered during the pulsing process. After the uppermost series of plates is cleaned, the water level 4 can be lowered to the next level of support plates such that it lies just below or just above the level of support plates 16 (or just below the upper surface 15 of the level of support plates 16) and then the pulsing process is repeated. This process is repeated sequentially for each lower level. Alternatively, the cleaning process can be started at the lower levels of support plates and then the water level is raised to clean the next higher level of support plates and so on. After the cleaning at each level, the steam generator can be flushed to remove loosened particles of deposits 60. Alternatively, the technique can involve starting with water level just below the support plate, and then raising the level just above each support plate as it is being cleaned by the pressure pulse shock waves, and back and forth in this manner at a speed of between 0.001 and 10 inches per minute.

One type of air gun which can be used is an air gun which generates a high pressure air source which for example can be 2000 psi modulated by a sharp rise-time value at a repetition of one Hertz to repeatedly introduce shock waves and pressure fluctuations into the liquid to create a slapping effect. In more general terms, the pressure pulse sources 80 should be capable of emitting a high pressure spherical shock wave of amplitude of between approximately 1 to 200 psi at a distance of one (1) foot from the pulser source 80. The power at the source inside the gun or pressure pulse can be approximately 100 to 5000 psi in order to create an amplitude of 1 to 200 psi at a distance of one (1) foot from the source. A typical source an have a chamber volume approximately ½ cubic inches to approximately 50 cubic inches. Frequencies of the spherical shock waves produced can range from approximately 0 Hertz to 1000 Hertz. The effect, therefore, is to tear a hole in the water, impinge upon the encrusted deposits, agitate it and loosen it, and then allow the deposits to remain in suspension from which the deposits can be removed. The water slapping velocity can be from approximately 0.1 to 10 inches per second. If, by way of example, approximately 8 pressure pulse shock wave sources 80 are inserted in the lower portion of of the steam generator and through the hand holes 13 or 14 or into the downcomer area 90, and each such source has a chamber volume of 10 cubic inches and each source is pressurized at approximately 1000 psi, then the shock wave 100 will reach at least 30 feet up into a steam generator whose internal chamber diameter is approximately 12 feet with sufficient power to loosen the deposits 60.

Depending upon the extent of the sludge and the amount and intensity of the desired applied pressure pulse, the time over which the pressure pulses are provided can range from approximately 1 hour to approximately 24 hours.

Another advantage of using the pressure pulse technique is that the spherical shock waves emitted can reflect off various surfaces of the heat exchanger tubes 32 to thereby clean the tubes from the rear as well as from the direct frontal impact of the spherical shock wave. This facilitates the use of fewer pressure pulse shock wave sources 80. While any type of air generating pressure source is within the spirit and scope of the present invention, it is preferred that the source emit a nonoxidizing gas such as nitrogen. In this way, oxygen will not be placed inside the steam generator 10. This is important because oxygen will lead to corrosion of the steam generator components which is exactly the problem the present invention is addressing.

The methods for cleaning the heat exchanger tubes and the other surfaces such as the internal side walls of the heat exchanger vessel are comparable to the above described method for cleaning corrosion deposits 60 from the tube support plates 16 and/or flow holes 140 or 240. The same pressure pulse shock wave sources 80 are placed inside the steam generator 10 and the level of a liquid such as water 4 is raised to a level just below (for example approximately 1/16th of an inch below) the area of heat exchanger tubes 32 or area of steam generator internal wall 72 to be cleaned. It will be appreciated that the previous cleaning effort on the tube support plates 32 will have an impact on these other deposits. However, for specific areas of encrustation not adjacent the tube support plates, it will be necessary to apply the specific cleaning application to that area. The pressure pulse shock wave sources 80 are then activated to the ranges previously described in order to create the water slapping effect which will impact the encrusted deposits, loosen them, and cause them to go into suspension in the water medium from which they can be removed through the flushing and vacuuming operation previously described. After the specific area is cleaned, the water level can then be lowered (or raised) to the next area to be cleaned and once again raised to a level a few inches below that area in order to achieve the maximum water slapping effect. The operation can be sequentially performed in this fashion in order to clean all areas of the heat exchanger vessel which have corrosive deposits thereon.

One additional variation on the present invention is to continuously vary the water level within the steam generator while the pressure pulse shock wave sources are being emitted. The water level can start near the bottom of the heat exchanger vessel and be slowly raised while the pulsing or shock wave emission is taking place until the entire elevation of the steam generator has been filled and cleaned. Alternatively, the water level can start at the top of the steam generator and be slowly lowered while the pulsing or shock wave emission is taking place until the water level is lowered to adjacent the tube sheet. The suggested rate of water level variation (either up or down) is between approximately 0.001 and 10 inches per minute. The continuous variation serves to enhance the pressure pulses and the water slapping effect on all areas of the steam generator vessel and provides added efficiency in cleaning all areas of the steam generator in one process.

So far the present invention has been described with the use of an air or gas source. It is also within the spirit and scope of the present invention to provide a pressure pulse shock wave source 80 from a water source or an electrical spark source. An air source, a water source and an electrical source are all usable with the present invention provided the source creates a shock wave or pressure pulse which travels radially outward from the source, thereby giving everything in its path a kick. The repetitions can be approximately once each second with the frequencies and pressures previously set forth.

So far, the present invention has been described as being used only with water which acts as a cap over the sources of sonic waves. As previously mentioned, one advantage of the present invention is that it can be used without corrosive chemicals which might damage the components of the steam generator 10. However, the present invention can be used with cleaning solvents and chemicals in conjunction with or else without the water. When used in conjunction with the chemicals, the use of the repetitive shock wave or pressure pulse induced in the cleaning solvent, water or chemical, provides agitation to loosen and transport the corrosion deposit and to bring fresh solvent to the corrosion/solvent interface. The technique, therefore, can be used to remove heavily encrusted deposits such as magnetite from the junctions of the heat exchanger tubes 32 and their associated tube supports plates 16 or from the flow holes 140 or 240. The pressure pulse or shock wave moves into and laterally of the junction between the tube support plate and the heat exchanger tubes, to thereby remove used solvent and allow fresh chemical solvent to arrive at the junction to eat away at the encrusted magnetite. When chemical solvent is used, the solvent level is usually raised above the area to be cleaned.

A major advantage of the present method is that all components of the steam generator can remain in their operative positions inside the steam generator while the present method is being used. The steam generator depicted in FIG. 1 is known as a U-bend type steam generator. Another common type of steam generator is known as a once through steam generator. In the once through steam generator, the heat exchanger tubes run the length of the vessel and the primary fluid enters at one end of the vessel and exits at the other end of the vessel (as opposed to the embodiment shown in FIG. 1 wherein the tubes are bent in the U-shape and therefore the primary fluid enters and exits at the same end of the vessel.) The present invention can work equally well for a once through type steam generator in addition to a U-bend type steam generator.

The deposits which can be removed by the methods of the present invention include radioactive scale. The steam generator can, for example, be a nuclear reactor core barrel.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the method shown is intended only for illustration and for disclosure of an operative embodiment and not to show all of the various forms of modification in which the invention might be embodied.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. In the art of removing corrosive deposits from locations within a heat exchanger in which the heat exchanger is characterized by an enclosed tank containing a plurality of heat exchanger tubes which are closely packed together and a plurality of support plates arranged transverse to and sequentially spaced along the longitudinal axis of the heat exchanger tubes and forming junctions therewith, where the support plates contain a multiplicity of transverse holes extending through their entire thickness and where crevices exist between the outer surface of the heat exchanger tubes and the support plates at the site of the junctions and wherein these crevices and the holes in the support plates act as flow holes to permit liquid which is placed in the enclosed tank to rise to a multiplicity of levels within the tank, the heat exchanger also containing an outer shell and a tube support sheet at the lower extremity of the tank to provide a base support for the multiplicity of heat exchanger tubes, the outer shell containing a multiplicity of openings known as hand holes adjacent the tube support sheet and another multiplicity of openings known as manways and additional hand holes located at various locations on the shell through which objects may be inserted into the heat exchanger, wherein the region defined between the outer shell and all of the outer surfaces of all of the heat exchanger tubes is known as the secondary side, and wherein products of corrosion, oxidation and sedimentation tend to build up and form deposits on said tube support plates and further within the flow holes to thereby occlude one or more flow holes, the process of removing the deposits from the tube support plates and the flow holes while the heat exchanger tubes and support plates remain in their operative position inside the heat exchanger, comprising the steps of:

a. selecting at least one air-gun type pressure pulse shock wave source and placing the at least one-gun type pressure pulse shock wave source into the secondary side of said heat exchanger;

b. filling said heat exchanger with a liquid to a level just below the tube support plate to be cleaned;

c. activating said at least one air-gun type pressure pulse shock wave source to generate a series of repetitive shock waves which are generated with a source pressure between approximately 100 pounds per square inch and 5000 pounds per square inch which result in an energy pulse in the frequency range between approximately 1 Hertz and 1000 Hertz for each pulse to create a pulse amplitude between approximately 1 and 200 pounds per square inch at a distance of approximately one foot from the at least one air-gun type pressure pulse shock wave source;

d. continuously generating said shock waves for a period between approximately one hour to approximately twenty-four hours until the deposits have been loosened and removed from the exposed surfaces of the tube support plate and the flow holes within the tube support plate so that the tube support plate and flow holes are clean;

e. changing the water level to a level just below the next tube support plate to be cleaned and continuing the generation of shock waves until the next support plate and flow holes therein are cleaned; and f. continuing in this fashion at the level of each successive tube support plate and flow holes to be cleaned until all of said tube support plates and flow holes have been cleaned.

2. In the art of removing corrosive deposits from locations within a heat exchanger in which the heat exchanger is characterized by an enclosed tank containing a plurality of heat exchanger tubes which are closely packed together and a plurality of support plates arranged transverse to and sequentially spaced along the longitudinal axis of the heat exchanger tubes and forming junctions therewith, where the support plates contain a multiplicity of transverse holes extending through their entire thickness and where crevices exist between the outer surface of the heat exchanger tubes and the support plates at the site of the junctions and wherein these crevices and the holes in the support plates act as flow holes to permit liquid which is placed in the enclosed tank to rise to a multiplicity of levels within the tank, the heat exchanger also containing an outer shell and a tube support sheet at the lower extremity of the tank to provide a base support for the multiplicity of heat exchanger tubes, the outer shell containing a multiplicity of openings known as hand holes adjaent the tube support sheet and another multiplicity of openings known as manways and additional hand holes located at various locations on the shell through which objects may be inserted into the heat exchanger, wherein the region defined between the outer shell and all of the outer surfaces of all of the heat exchanger tubes is known as the secondary side, and wherein products of corrosion, oxidation and sedimentation tend to build up and form deposits on said tube support plates and further within the flow holes to thereby occlude one or more flow holes, the process of removing the deposits from the tube support plates and the flow holes while the heat exchanger tubes and support plates remain in their operative position inside the heat exchanger, comprising the steps of:

a. selecting at least one air-gun type pressure pulse shock wave source and placing the at least one air-gun type pressure pulse shock wave source into the secondary side of the heat exchanger;

b. filling said heat exchanger wiTh a liquid to a level just above the tube support plate to be cleaned;

c. activating said at least one air-gun type pressure pulse shock wave source to generate a series of repetitive shock waves which are generated with a source pressure between approximately 100 pounds per square inch and 5000 ;pounds per square inch which result in an energy pulse in the frequency range between approximately 1 Hertz and 1000 Hertz for each pulse to create a pulse amplitude between approximately 1 and 200 pounds per square inch at a distance of approximately one foot from the at least one air-gun type pressure pulse shock wave source;

d. continuously generating said shock waves for a period between approximately one hour to approximately twenty-four hours until the deposits have been loosened and removed from the surfaces of the tube support plate and the flow holes within the tube support plate just below the level of the liquid so that the tube support plate and flow holes are clean;

e. changing the water level to a level just above the next tube support plate to be cleaned and continuing the generation of shock waves until the next support plate and flow holes therein are cleaned; and f. continuing in this fashion at the level of each successive tube support plate and flow holes to be cleaned until all of said tube support plates and flow holes have been cleaned.

3. In the art of removing corrosive deposits from locations within a heat exchanger in which the heat exchanger is characterized by an enclosed tank containing a plurality of heat exchanger tubes which are closely packed together and a plurality of support plates arranged transverse to and sequentially spaced along the longitudinal axis of the heat exchanger tubes and forming junctions therewith, where the support plats contain a multiplicity of transverse holes extending through their entire thickness and where crevices exist between the outer surface of the heat exchanger tubes and the support plates at the site of the junctions and wherein these crevices and the holes in the support plates act as flow holes to permit liquid which is placed in the enclosed tank to rise to a multiplicity of levels within the tank, the heat exchanger also containing an outer shell and a tube support sheet at the lower extremity of the tank to provide a base support for the multiplicity of heat exchanger tubes, the outer shell containing a multiplicity of openings known as hand holes adjacent the tube support sheet and another multiplicity of openings known as manways and additional hand holes located at various locations on the shell through which objects may be inserted into the heat exchanger, wherein the region defined between the outer shell and all of the outer surfaces of all of the heat exchanger tubes is known as the secondary side; and wherein products of corrosion, oxidation and sedimentation tend to build up and form deposits on said tube support plates and further within the flow holes to thereby occlude one or more flow holes, the process of removing the deposits from the tube support plates and the flow holes while the heat exchanger tubes and support plates remain in their operative position inside the heat exchanger, comprising the steps of:

a. selecting at least one air-gun type pressure pulse shock wave source and placing the at least one air-gun type pressure pulse shock wave source into the secondary side of said heat exchanger;

b. filling said heat exchanger with a liquid to a level between the upper and lower surface of the tube support plate to be cleaned;

c. activating said at least one air-gun type pressure pulse shock wave source to generate a series of repetitive shock waves which are generated with a source pressure between approximately 100 pounds per square inch and 5000 pounds per square inch which result in an energy pulse in the frequency range between approximately 1 Hertz and 1000 Hertz for each pulse to create a pulse amplitude between approximately 1 and 200 pounds per square inch at a distance of approximately one foot from the at least one air-gun type pressure pulse shock wave source;

d. continuously generating said shock waves for a period between approximately one hour to approximately twenty-four hours until the deposits have been loosened and removed from the surfaces of the tube support plate and the flow holes within the level of the liquid so that the tube support plate and flow holes are clean;

e. changing the water level to a level within the thickness of the next tube support plate to be cleaned and continuing the generation of shock waves until the next support plate and flow holes therein are cleaned; and f. continuing in this fashion at the level of each successive tube support plate and flow holes to be cleaned until all of said tube support plates and flow holes have been cleaned.

4. In the art of removing corrosive deposits from locations within a heat exchanger in which the heat exchanger is characterized by an enclosed tank containing a plurality of heat exchanger tubes which are closely packed together and a plurality of support plates arranged transverse to and sequentially spaced along the longitudinal axis of the heat exchanger tubes and forming junctions therewith, where the support plates contain a multiplicity of transverse holes extending through their entire thickness and where crevices exist between the outer surface of the heat exchanger tubes and the support plates at the site of the junctions and wherein these crevices and the holes in the support plates act as flow holes to permit liquid which is placed in the enclosed tank to rise to a multiplicity of levels within the tank, the heat exchanger also containing an outer shell and a tube support sheet at the lower extremity of the tank to provide a base support for the multiplicity of heat exchanger tubes, the outer shell containing a multiplicity of openings known as hand holes adjacent the tube support sheet and another multiplicity of openings known as manways and additional hand holes located at various locations on the shell through which objects may be inserted into the heat exchanger, wherein the region defined between the outer shell and all of the outer surfaces of all of the heat exchanger tubes is known as the secondary side, and wherein products of corrosion, oxidation and sedimentation tend to build up and form deposits on said tube support plates and further within the flow holes to thereby occlude one or more flow holes, the process of removing the deposits from the tube support plates and the flow holes while the heat exchanger tubes and support plates remain in their operative position inside the heat exchanger, comprising the steps of:

a. selecting at least one air-gun type pressure pulse shock wave source and placing the at least one air-gun type pressure pulse shock wave source into the secondary side of said heat exchanger;

b. filling said heat exchanger with a liquid to a level just above the support plate to be cleaned;

c. activating said at least one air-gun type pressure pulse shock wave source to generate a series of repetitive shock waves which are generated with a source pressure between approximately 100 pounds per square inch and 5000 pounds per square inch which reach an energy pulse in the frequency range between approximately 1 Hertz and 1000 Hertz for each pulse to create a pulse amplitude between approximately 1 and 200 pounds per square inch at a distance of approximately one foot from the at least one air-gun type pressure pulse shock wave source;

d. varying the level of liquid from above to just below the tube support plate and flow holes to be cleaned and then back and forth in this manner at a speed of between 0.001 and 10 inches per minute while the shock waves are being generated;

e. continuously generating said shock waves for a period between approximately one hour to approximately twenty-four hours until the deposits have been loosened and removed from the surfaces of the tube support plate and the flow holes located adjacent the surface of the liquid so that the tube support plate and flow holes are clean;

f. changing the water level to a level just above the next tube support plate to be cleaned and continuing the generation of shock waves and variation of the level of the liquid relative to the support plate until the next support plate and flow holes therein are cleaned; and g. continuing in this fashion at the level of each successive tube support plate and flow holes to be cleaned until all of said tube support plates and flow holes have been cleaned.

5. In the art of removing corrosive deposits from locations within a heat exchanger in which the heat exchanger is characterized by an enclosed tank containing a plurality of heat exchanger tubes which are closely packed together and a plurality of support plates arranged transverse to and sequentially spaced along the longitudinal axis of the heat exchanger tubes and forming junctions therewith, where the support plates contain a multiplicity of transverse holes extending through their entire thickness and where crevices exist between the outer surface of the heat exchanger tubes and the support plates at the site of the junctions and wherein these crevices and the holes in the support plates act as flow holes to permit liquid which is placed in the enclosed tank to rise to a multiplicity of levels within the tank, the heat exchanger also containing an outer shell and a tube support sheet at the lower extremity of the tank to provide a base support for the multiplicity of heat exchanger tubes, the outer shell containing a multiplicity of openings known as hand holes adjacent the tube support sheet and another multiplicity of openings known as manways and additional hand holes located at various locations on the shell through whch objects may be inserted into the heat exchanger, wherein the region defined between the outer shell and all of the outer surfaces of all of the heat exchanger tubes is known as the secondary side, and wherein products of corrosion, oxidation and sedimentation tend to build up and form deposits on said tube support plates and further within the flow holes to thereby occlude one or more flow holes, the process of removing the deposits from the tube support plates and the flow holes while the heat exchanger tubes and support plates remain in their operative position inside the heat exchanger, comprising the steps of:

a. selecting at least one air-gun type pressure pulse shock wave source and placing the at least one air-gun type pressure pulse shock wave source into the secondary side of said heat exchanger;

b. filling said heat exchanger with a liquid to a level just below the tube support plate to be cleaned;

c. activating said at leat one air-gun type pressure pulse shock wave source to generate a series of repetitive shock waves which are generated with a source presure between approximately 100 pounds per square inch and 5000 pounds per square inch which result in an energy pulse in the frequency range between approximately 1 Hertz and 1000 Hertz for each pulse to create a pulse amplitude between approximately 1 and 200 pounds per square inch at a distance of approximately one foot from the at least one air-gun type pressure pulse shock wave source;

d. varying the level of liquid from just below to just above the tube support plate and flow holes to be cleaned and then back and forth in this manner at a speed of between 0.001 and 10 inches per minute while the shock waves are being generated;

e. continuously generating said shock waves for a period between approximately one hour to approximately twenty-four hours until the deposits have been loosened and removed from the surfaces of the tube support plate and the flow holes located adjacent the surface of the liquid so that the tube support plate and flow holes are clean;

f. changing the water level to a level just below the next tube support plate to be cleaned and continuing the generation of shock waves and variation of the level of the liquid relative to the support plate until the next support plate and flow holes therein are cleaned; and g. continuing in this fashion at the level of each successive tube support plate and flow holes to be cleaned until all of said tube support plates and flow holes have been cleaned.

6. In the art of removing corrosive deposits from locations within a heat exchanger in which the heat exchanger is characterized by an enclosed tank containing a plurality of heat exchanger tubes which are closely packed together and a plurality of support plates arranged transverse to and sequentially spaced along the longitudinal axis of the heat exchanger tubes and forming junctions therewith, where the support plates contain a multiplicity of transverse holes extending through their entire thickness and where crevices exist between the outer surface of the heat exchanger tubes and the support plates at the site of the junctions and wherein these crevices and the holes in the support plates act as flow holes to permit liquid which is placed in the enclosed tank to rise to a multiplicity of levels within the tank, the heat exchanger also containing an outer shell and a tube support sheet at the lower extremity of the tank to provide a base support for the multiplicity of heat exchanger tubes, the outer shell containing a multiplicity of openings known as hand holes adjacent the tube support sheet and another multiplicity of openings known as manways and additional hand holes located at various locations on the shell through which objects may be inserted into the heat exchanger, wherein the region defined between the outer shell and all of the outer surfaces of all of the heat exchanger tubes is known as the secondary side, and wherein products of corrosion, oxidation and sedimentation tend to build up and form deposits on said tube support plates and further within the flow holes to thereby occlude one or more flow holes, the process of removing the deposits from the tube support plates and the flow holes while the heat exchanger tubes and support plates remain in their operative position inside the heat exchanger, comprising the steps of:

a. selecting at least one air-gun type pressure pulse shock wave source and placing the at least one air-gun type pressure pulse shock wave source into the secondary side of said heat exchanger;

b. filling said heat exchanger with a liquid to a level below the lowermost tube support plate to be cleaned;

c. activating said at least one air-gun type pressure pulse shock wave source to generate a series of repetitive shock waves which are generated with a source pressure between approximately 100 pounds per square inch and 5000 pounds per square inch which result in an energy pulse in the frequency range between approximately 1 Hertz and 1000 Hertz for each pulse to create a pulse amplitude between approximately 1 and 200 pounds per square inch at a distance of approximately one foot from the at least one air-gun type pressure pulse shock wave source;

d. filling the heat exchanger with additional liquid at a rate between approximately 0.001 and 10 inches per minute while the shock wave sources are being generated until the level of liquid is above the uppermost tube support plate to be cleaned; and e. continuously generating said shock waves for a period between approximately one hour to approximately twenty-four hours until the deposits have been loosened and removed from the surfaces of all of the tube support plates and the flow holes within each tube support plate so that all of the tube support plates and flow holes are clean.

7. In the art of removing corrosive deposits from locations within a heat exchanger in which the heat exchanger is characterized by an enclosed tank containing a plurality of heat exchanger tubes which are closely packed together and a plurality of support plates arranged transverse to and sequentially spaced along the longitudinal axis of the heat exchanger tubes and forming junctions therewith, where the support plates contain a multiplicity of transverse holes extending through their entire thickness and where crevices exist between the outer surface of the heat exchanger tubes and the support plates at the site of the junctions and wherein these crevices and the holes in the support plates act as flow holes to permit liquid which is placed in the enclosed tank to rise to a multiplicity of levels within the tank, the heat exchanger also containing an outer shell and a tube support sheet at the lower extremity of the tank to provide a base support for the multiplicity of heat exchanger tubes, the outer shell containing a multiplicity of openings known as hand holes adjacent the tube support sheet and another multiplicity of openings known as manways and additional hand holes located at various locations on the shell through which objects may be inserted into the heat exchanger, wherein the region defined between the outer shell and all of the outer surfaces of all of the heat exchanger tubes is known as the secondary side, and wherein products of corrosion, oxidation and sedimentation tend to build up and form deposits on said tube support plates and further within the flow holes to thereby occlude one or more flow holes, the process of removing the deposits from the tube support plates and the flow holes while the heat exchanger tubes and support plates remain in their operative position inside the heat exchanger, comprising the steps of:

a. selecting at least one air-gun type pressure pulse shock wave source and placing the at least one air-gun type pressure pulse shock wave source into the secondary side of said heat exchanger;
b. filling said heat exchanger with a liquid to a level above the uppermost tube support plate to be cleaned;
c. activating said at least one air-gun type pressure pulse shock wave source to generate a series of repetitive shock waves which are generated with a source pressure between approximately 100 pounds per square inch and 5000 pounds per square inch which result in an energy pulse in the frequency range between approximately 1 Hertz and 1000 Hertz for each pulse to create a pulse amplitude between approximately 1 and 200 pounds per square inch at a distance of approximately one foot from the at least one air-gun type pressure pulse shock wave sources;
d. removing liquid from the heat exchanger at a rate between approximately 0.001 and 10 inches per minute while the shock wave sources are being generated until the level of liquid is below the lowermost tube support plate to be cleaned; and
e. continuously generating said shock waves for a period between approximately one hour to approximately twenty-four hours until the deposits have been loosened and removed from the surfaces of all of the tube support plates and the flow holes within each tube support plate so that all of the tube support plates and flow holes are clean.

8. In the art of removing corrosive deposits from locations within a heat exchanger in which the heat exchanger is characterized by an enclosed tank containing a plurality of heat exchanger tubes which are closely packed together and a plurality of support plates arranged transverse to and sequentially spaced along the longitudinal axis of the heat exchanger tubes and forming junctions therewith, where the support plates contain a multiplicity of transverse holes extending through their entire thickness and where crevices exist between the outer surface of the heat exchanger tubes and the support plates at the site of the junctions and wherein these crevices and the holes in the support plates act as flow holes to permit liquid which is placed in the enclosed tank to rise to a multiplicity of levels within the tank, the heat exchanger also containing an outer shell and a tube support sheet at the lower extremity of the tank to provide a base support for the multiplicity of heat exchanger tubes, the outer shell containing a multiplicity of openings known as hand holes adjacent the tube support sheet and another multiplicity of openings known as manways and additional hand holes located at various locations on the shell through which objects may be inserted into the heat exchanger, and further containing a metal wrapper inside the tank which envelopes the plurality of heat exchanger tubes and support plates and which is set above the tube support sheet to thereby provide a space between the metal wrapper and tube support sheet, wherein the region defined between the outer shell and all of the outer surfaces of all of the heat exchanger tubes is known as the secondary side, and wherein products of corrosion, oxidation and sedimentation tend to build up and form deposits on said tube support plates and further within the flow holes to thereby occlude one or more flow holes, on heat exchanger tubes, on the metal wrapper, on the internal wall of the external shell, and on other heat exchanger components, the process of removing the deposits from all of the heat exchanger components while the heat exchanger tubes, tube support plates and all other components remain in their operative position inside the heat exchanger, comprising the steps of:

a. selecting at least one air-gun type pressure pulse shock wave source and placing the at least one air-gun type pressure pulse shock wave source into the secondary side of said heat exchanger;
b. filling said heat exchanger with a liquid to a level just below the area of the components of the heat exchanger to be cleaned;
c. activating said at least one air-gun type pressure pulse shock wave source to generate a series of repetitive shock waves which are generated with a source pressure between approximately 100 pounds per square inch and 5000 pounds per square inch which result in an energy pulse in the frequency range between approximately 1 Hertz and 1000 Hertz for each pulse to create a pulse amplitude between approximately 1 and 200 pounds per square inch at a distance of approximately one foot from the at least one air-gun type pressure pulse shock wave source;
d. continuously generating said shock waves for a period between approximately one hour to approximately twenty-four hours until the deposits have been loosened and removed from said area of the components of the heat exchanger to be cleaned;
e. changing the water level to a level just below the next area of the components of the heat exchanger to be cleaned and continuing the generation of shock waves until the next support plate and flow holes therein are cleaned; and
f. continuing in this fashion at the level of each area of the components of the heat exchanger to be cleaned until all of said areas have been cleaned.

9. In the art of removing corrosive deposits from locations within a heat exchanger in which the heat exchanger is characterized by an enclosed tank containing a plurality of heat exchanger tubes which are closely packed together and a plurality of support plates arranged transverse to and sequentially spaced along the longitudinal axis of the heat exchanger tubes and forming junctions therewith, where the support plates contain a multiplicity of transverse holes extending through their entire thickness and where crevices exist between the outer surface of the heat exchanger tubes and the support plates at the site of the junctions and wherein these crevices and the holes in the support plates act as flow holes to permit liquid which is placed in the enclosed tank to rise to a multiplicity of levels within the tank, the heat exchanger also containing an outer shell and a tube support sheet at the lower extremity of the tank to provide a base support for the multiplicity of heat exchanger tubes, the outer shell containing a multiplicity of openings known as hand holes adjacent the tube support sheet and another multiplicity of openings known as manways and additional hand holes located at various locations on the shell through which objects may be inserted into the heat exchanger, and further containing a metal wrapper inside the tank which envelopes the plurality of heat exchanger tubes and support plates and which is set above the tube support sheet to thereby provide a space between the metal wrapper and tube support sheet, wherein the region defined between the outer shell and all of the outer surfaces of all of the heat exchanger tubes is known as the secondary side, and wherein products of corrosion, oxidation and sedimentation tend to build up and form deposits on said tube support plates and further within the flow holes to thereby occlude one or more flow holes, on heat exchanger tubes, on the metal wrapper, on the internal wall of the external shell, and on other heat exchanger components, the process of removing the deposits from all of the heat exchanger components while the heat exchanger tubes, tube support plates and all other components remain in their operative position inside the heat exchanger, comprising the steps of:

a. selecting at least one air-gun type pressure pulse shock wave source and placing the at least one air-gun type pressure pulse shock wave source into the secondary side of said heat exchanger;
b. filling the entire heat exchanger with a liquid;
c. activating said at least one air-gun type pressure pulse shock wave source to generate a series of repetitive shock waves which are generated with a source pressure between approximately 100 pounds per square inch and 5000 pounds per square inch which result in an energy pulse in the frequency range between approximately 1 Hertz and 1000 Hertz for each pulse to create a pulse amplitude between approximately 1 and 200 pounds per square inch at a distance of approximately one foot from the at least one air-gun type pressure pulse shock wave source; and
d. continuously generating said shock waves for a period between approximately one hour to approximately twenty-four hours until the deposits have been loosened and removed from said area of the components of the heat exchanger to be cleaned.

10. In the art of removing corrosive deposits from locations within a heat exchanger in which the heat exchanger is characterized by an enclosed tank containing a plurality of heat exchanger tubes which are closely packed together and a plurality of support plates arranged transverse to and sequentially spaced along the longitudinal axis of the heat exchanger tubes and forming junctions therewith, where the support plates contain a multiplicity of transverse holes extending through their entire thickness and where crevices exist between the outer surface of the heat exchanger tubes and the support plates at the site of the junctions and wherein these crevices and the holes in the support plates act as flow holes to permit liquid which is placed in the enclosed tank to rise to a multiplicity of levels within the tank, the heat exchanger also containing an outer shell and a tube support sheet at the lower extremity of the tank to provide a base support for the multiplicity of heat exchanger tubes, the outer shell containing a multiplicity of openings known as hand holes adjacent the tube support sheet and another multiplicity of openings known as manways and additional hand holes located at various locations on the shell through which objects may be inserted into the heat exchanger, wherein the region defined between the outer shell and all of the outer surfaces of all of the heat exchanger tubes is known as the secondary side, and wherein products of corrosion, oxidation and sedimentation tend to build up and form deposits on said tube suppoort plates and further within the flow holes to thereby occlude one or more flow holes, the process of removing the deposits from the tube support plates and the flow holes while the heat exchanger tubes and support plates remain in their operative position inside the heat exchanger, comprising the steps of:

a. selecting at least one pressurized gas-type pressure pulse shock wave source and placing the at least one pressurized gas-type pressure pulse shock wave source into the secondary side of said heat exchanger;
b. filling said heat exchanger with a liquid to a level just below the tube support plate to be cleaned;
c. activating said at least one pressurized gas-type pressure pulse shock wave source to generate a series of repetitive shock waves which are generated with a source pressure between approximately 100 pounds per square inch and 5000 pounds per square inch which result in an energy pulse in the frequency range between approximately 1 Hertz and 1000 Hertz for each pulse to create a pulse amplitude between approximately 1 and 200 pounds per square inch at a distance of approximately one foot from the at least one pressurized gas-type pressure pulse shock wave source;
d. continuously generating said shock waves for a period between approximately one hour to approximately twenty-four hours until the deposits have been loosened and removed from the exposed surfaces of the tube support plate and the flow holes within the tube support plate so that the tube support plate and flow holes are clean;
e. changing the water level to a level just below the next tube support plate to be cleaned and continuing the generation of shock waves until the next support plate and flow holes therein are cleaned; and
f. continuing in this fashion at the level of each successive tube support plate and flow holes to be cleaned until all of said tube support plates and flow holes have been cleaned.

11. In the art of removing corrosive deposits from locations within a heat exchanger in which the heat exchanger is characterized by an enclosed tank containing a plurality of heat exchanger tubes which are closely packed together and a plurality of support plates arranged transverse to and sequentially spaced along the longitudinal axis of the heat exchanger tubes and forming junctions therewith, where the support plates contain a multiplicity of transverse holes extending through their entire thickness and where crevices exist between the outer surface of the heat exchanger tubes and the support plates at the site of the junctions and wherein these crevices and the holes in the support plates act as flow holes to permit liquid which is placed in the enclosed tank to rise to a multiplicity of levels within the tank, the heat exchanger also containing an outer shell and a tube support sheet at the lower extremity of the tank to provide a base support for the multiplicity of heat exchanger tubes, the outer shell containing a multiplicity of openings known as hand holes adjacent the tube support sheet and another multiplicity of openings known as manways and additional hand holes located at various locations on the shell through which objects may be inserted into the heat exchanger, wherein the region defined between the outer shell and all of the outer surfaces of all of the heat exchanger tubes is known as the secondary side, and wherein products of corrosion, oxidation and sedimentation tend to build up and form deposits on said tube support plates and further within the flow holes to thereby occlude one or more flow holes, the process of removing the deposits from the tube support plates and the flow holes while the heat exchanger tubes and support plates remain in their operative position inside the heat exchanger, comprising the steps of:

a. selecting at least one pressurized gas-type pressure pulse shock wave source and placing the at least one pressurized gas-type pressure pulse shock wave source into the secondary side of said heat exchanger;
b. filling said heat exchanger with a liquid to a level just above the tube support plate to be cleaned;
c. activating said at least one pressurized gas-type pressure pulse shock wave source to generate a series of repetitive shock waves which are generated with a source pressure between approximately 100 pounds per square inch and 5000 pounds per square inch which result in an energy pulse in the frequency range between approximately 1 Hertz and 1000 Hertz for each pulse to create a pulse amplitude between approximately 1 and 200 pounds per square inch at a distance of approximately one foot from the at least one pressurized gas-type pressure pulse shock wave source;
d. continuously generating said shock waves for a period between approximately one hour to approximately twenty-four hours until the deposits have been loosened and removed from the surfaces of the tube support plate and the flow holes within the tube support plate just below the level of the liquid so that the tube support plate and flow holes are clean;
e. changing the water level to a level just above the next tube support plate to be cleaned and continuing the generation of shock waves until the next support plate and flow holes therein are cleaned; and
f. continuing in this fashion at the level of each successive tube support plate and flow holes to be cleaned until all of said tube support plates and flow holes have been cleaned.

12. In the art of removing corrosive deposits from locations within a heat exchanger in which the heat exchanger is characterized by an enclosed tank containing a plurality of heat exchanger tubes which are closely packed together and a plurality of support plates arranged transverse to and sequentially spaced along the longitudinal axis of the heat exchanger tubes and forming junctions therewith, where the support plates contain a multiplicity of transverse holes extending through their entire thickness and where crevices exist between the outer surface of the heat exchanger tubes and the support plates at the site of the junctions and wherein these crevices and the holes in the support plates act as flow holes to permit liquid which is placed in the enclosed tank to rise to a multiplicity of levels within the tank, the heat exchanger also containing an outer shell and a tube support sheet at the lower extremity of the tank to provide a base support for the multiplicity of heat exchanger tubes, the outer shell containing a multiplicity of openings known as hand holes adjacent the tube support sheet and another multiplicity of openings known as manways and additional hand holes located at various locations on the shell through which objects may be inserted into the heat exchanger, wherein the region defined between the outer shell and all of the outer surfaces of all of the heat exchanger tubes is known as the secondary side, and wherein products of corrosion, oxidation and sedimentation tend to build up and form deposits on said tube support plates and further within the flow holes to thereby occlude one or more flow holes, the process of removing the deposits from the tube support plates and the flow holes while the heat exchanger tubes and support plates remain in their operative position inside the heat exchanger, comprising the steps of:

a. selecting at least one pressurized gas-type pressure pulse shock wave source and placing the at least one pressurized gas-type pressure pulse shock wave source into the secondary side of said heat exchanger;
b. filling said heat exchanger with a liquid to a level between the upper and lower surface of the tube support plate to be cleaned;
c. activating said at least one pressurized gas-type pressure pulse shock wave source to generate a series of repetitive shock waves which are generated with a source pressure between approximately 100 pounds per square inch and 5000 pounds per square inch which result in an energy pulse in the frequency range between approximately 1 Hertz and 1000 Hertz for each pulse to create a pulse amplitude between approximately 1 and 200 pounds per square inch at a distance of approximately one foot from the at least one pressurized gas-type pressure pulse shock wave source;
d. continuously generating said shock waves for a period between approximately one hour to approximately twenty-four hours until the deposits have been loosened and removed from the surfaces of the tube support plate and the flow holes within the the level of the liquid so that the tube support plate and flow holes are clean;
e. changing the water level to a level within the thickness of the next tube support plate to be cleaned and continuing the generation of shock waves until the next support plate and flow holes therein are cleaned; and
f. continuing in this fashion at the level of each successive tube support plate and flow holes to be cleaned until all of said tube support plates and flow holes have been cleaned.

13. In the art of removing corrosive deposits from locations within a heat exchanger in which the heat exchanger is characterized by an enclosed tank containing a plurality of heat exchanger tubes which are closely packed together and a plurality of support plates arranged transverse to and sequentially spaced along the longitudinal axis of the heat exchanger tubes and forming junctions therewith, where the support plates contain a multiplicity of transverse holes extending through their entire thickness and where crevices exist between the outer surface of the heat exchanger tubes and the support plates at the site of the junctions and wherein these crevices and the holes in the support plates act as flow holes to permit liquid which is placed in the enclosed tank to rise to a multiplicity of levels within the tank, the heat exchanger also containing an outer shell and a tube support sheet at the lower extremity of the tank to provide a base support for the multiplicity of heat exchanger tubes, the outer shell containing a multiplicity of openings known as hand holes adjacent the tube support sheet and another multiplicity of openings known as manways and additional hand holes located at various locations on the shell through which objects may be inserted into the heat exchanger, wherein the region defined between the outer shell and all of the outer surfaces of all of the heat exchanger tubes is known as the secondary side, and wherein products of corrosion, oxidation and sedimentation tend to build up and form deposits on said tube support plates and further within the flow holes to thereby occlude one or more flow holes, the process of removing the deposits from the tube support plates and the flow holes while the heat exchanger tubes and support plates remain in their operative position inside the heat exchanger, comprising the steps of:

a. selecting at least one pressurized gas-type pressure pulse shock wave source and placing the at least one pressurized gas-type pressure pulse shock wave source into the secondary side of said head exchanger;
b. filling said heat exchanger with a liquid to a level just above the tube support plate to be cleaned;
c. activating said at least one pressurized gas-type pressure pulse shock wave source to generate a series of repetitive shock waves which are generated with a source pressure between approximately 100 pounds per square inch and 5000 pounds per square inch which result in an energy pulse in the frequency range between approximately 1 Hertz and 1000 Hertz for each pulse to create a pulse amplitude between approximately 1 and 200 pounds per square inch at a distance of approximately one foot from the at least one pressurized gas-type pressure pulse shock wave source;
d. varying the level of liquid from just above to just below the tube support plate and flow holes to be cleaned and then back and forth in this manner at a speed of between 0.001 and 10 inches per minute while the shock waves are being generated;
e. continuously generating said shock waves for a period between approximately one hour to approximately twenty-four hours until the deposits have been loosened and removed from the surfaces of the tube support plate and the flow holes located adjacent the surface of the liquid so that the tube support plate and flow holes are clean;
f. changing the water level to a level just above the next tube support plate to be cleaned and continuing the generation of shock waves and variation of the level of the liquid relative to the support plate until the next support plate and flow holes therein are cleaned; and
g. continuing in this fashion at the level of each successive tube support plate and flow holes to be cleaned until all of said tube support plates and flow holes have been cleaned.

14. In the art of removing corrosive deposits from locations within a heat exchanger in which the heat exchanger is characterized by an enclosed tank containing a plurality of heat exchanger tubes which are closely packed together and a plurality of support plates arranged transverse to and sequentially spaced along the longitudinal axis of the heat exchanger tubes and forming junctions therewith, where the support plates contain a multiplicity of transverse holes extending through their entire thickness and where crevices exist between the outer surface of the heat exchanger tubes and the support plates at the site of the junctions and wherein these crevices and the holes in the support plates act as flow holes to permit liquid which is placed in the enclosed tank to rise to a multiplicity of levels within the tank, the heat exchanger also containing an outer shell and a tube support sheet at the lower extremity of the tank to provide a base support for the multiplicity of heat exchanger tubes, the outer shell containing a multiplicity of openings known as hand holes adjacent the tube support sheet and another multiplicity of openings known as manways and additional hand holes located at various locations on the shell through which objects may be inserted into the heat exchanger, wherein the region defined between the outer shell and all of the outer surfaces of all of the heat exchanger tubes is known as the secondary side, and wherein products of corrosion, oxidation and sedimentation tend to build up and form deposits on said tube support plates and further within the flow holes to thereby occlude one or more flow holes, the process of removing the deposits from the tube support plates and the flow holes while the heat exchanger tubes and support plates remain in their operative position inside the heat exchanger, comprising the steps of:

a. selecting at least one pressurized gas-type pressure pulse shock wave source and placing the at least one pressurized gas-type pressure pulse shock wave source into the secondary side of said heat exchanger;
b. filling said heat exchanger with a liquid to a level just below the tube support plate to be cleaned;
c. activating said at least one pressurized gas-type pressure pulse shock wave source to generate a series of repetitive shock waves which are generated with a source pressure between approximately 100 pounds per square inch and 5000 pounds per square inch which result in an energy pulse in the frequency range between approximately 1 Hertz and 1000 Hertz for each pulse to create a pulse amplitude between approximately 1 and 200 pounds per square inch at a distance of approximately one foot from the at least one pressurized gas-type pressure pulse shock wave source;
d. varying the level of liquid from just below the just above the tube support plate and flow holes to be cleaned and then back and forth in this manner at a speed of between 0.001 and 10 inches per minute while the shock waves are being generated;
e. continuously generating said shock waves for a period between approximately one hour to approximately twenty-four hours until the deposits have been loosened and removed from the surfaces of the tube support plate and the flow holes located adjacent the surface of the liquid so that the tube support plate and flow holes are clean;
f. changing the water level to a level just below the next tube support plate to be cleaned and continuing the generation of shock waves and variation of the level of the liquid relative to the support plate until the next support plate and flow holes therein are cleaned; and
g. continuing in this fashion at the level of each successive tube support plate and flow holes to be cleaned until all of said tube support plates and flow holes have been cleaned.

15. In the art of removing corrosive deposits from locations within a heat exchanger in which the heat exchanger is characterized by an enclosed tank containing a plurality of heat exchanger tubes which are closely packed together and a plurality of support plates arranged transverse to and sequentially spaced along the longitudinal axis of the heat exchanger tubes and forming junctions therewith, where the support plates contain a multiplicity of transverse holes extending through their entire thickness and where crevices exist between the outer surface of the heat exchanger tubes and the support plates at the site of the junctions and wherein these crevices and the holes in the support plates act as flow holes to permit liquid which is placed in the enclosed tank to rise to a multiplicity of levels within the tank, the heat exchanger also containing an outer shell and a tube support sheet at the lower extremity of the tank to provide a base support for the multiplicity of heat exchanger tubes, the outer shell containing a multiplicity of openings known as hand holes adjacent the tube support sheet and another multiplicity of openings known as manways and additional hand holes located at various locations on the shell through which objects may be inserted into the heat exchanger, wherein the region defined between the outer shell and all of the outer surfaces of all of the heat exchanger tubes is known as the secondary side, and wherein products of corrosion, oxidation and sedimentation tend to build up and form deposits on said tube support plates and further within the flow holes to thereby occlude one or more flow holes, the process of removing the deposits from the tube support plates and the flow holes while the heat exchanger tubes and support plates remain in their operative position inside the heat exchanger, comprising the steps of:

a. selecting at least one pressurized gas-type pressure pulse shock wave source and placing the at least one pressurized gas-type pressure pulse shock wave source into the secondary side of said heat exchanger;
b. filling said heat exchanger with a liquid to a level below the lowermost tube support plate to be cleaned;
c. activating said at least one pressurized gas-type pressure pulse shock wave source to generate a series of repetitive shock waves which are generated with a source pressure between approximately 100 pounds per square inch and 5000 pounds per square inch which reach an energy pulse in the frequency range between approximately 1 Hertz and 1000 Hertz for each pulse to create a pulse amplitude between approximately 1 and 200 pounds per square inch at a distance of approximately one foot from the at least one pressurized gas-type pressure pulse shock wave source;
d. filling the heat exchanger with additional liquid at a rate between approximately 0.001 and 10 inches per minute while the shock wave sources are being generated until the level of liquid is above the uppermost tube support plate to be cleaned; and
e. continuously generating said shock waves for a period between appoximately one hour to approximately twenty-four hours until the deposits have been loosened and removed from the surfaces of all of the tube support plates and the flow holes within each tube support plate so that all of the tube support plates and flow holes are clean.

16. In the art of removing corrosive deposits from locations within a heat exchanger in which the heat exchanger is characterized by an enclosed tank containing a plurality of heat exchanger tubes which are closely packed together and a plurality of support plates arranged transverse to and sequentially spaced along the longitudinal axis of the heat exchanger tubes and forming junctions therewith, where the support plates contain a multiplicity of transverse holes extending through their entire thickness and where crevices exist between the outer surface of the heat exchanger tubes and the support plates at the site of the junctions and wherein these crevices and the holes in the support plates act as flow holes to permit liquid which is placed in the enclosed tank to rise to a multiplicity of levels within the tank, the heat exchanger also containing an outer shell and a tube support sheet at the lower extremity of the tank to provide a base support for the multiplicity of heat exchanger tubes, the outer shell containing a multiplicity of openings known as hand holes adjacent the tube support sheet and another multiplicity of openings known as manways and additional hand holes located at various locations on the shell through which objects may be inserted into the heat exchanger, wherein the region defined between the outer shell and all of the outer surfaces of all of the heat exchanger tubes is known as the secondary side, and wherein products of corrosion, oxidation and sedimentation tend to build up and form deposits on said tube support plates and further within the flow holes to thereby occlude one or more flow holes, the process of removing the deposits from the tube support plates and the flow holes while the heat exchanger tubes and support plates remain in their operative position inside the heat exchanger, comprising the steps of:

a. selecting at least one pressurized gas-type pressure pulse shock wave source and placing the at least one pressurized gas-type pressure pulse shock wave source into the secondary side of said heat exchanger;
b. filling said heat exchanger with a liquid to a level above the uppermost tube support plate to be cleaned;
c. activating said at least one pressurized gas-type pressure pulse shock wave source to generate a series of repetitive shock waves which are generated with a source pressure between approximately 100 pounds per square inch and 5000 pounds per square inch which reach an energy pulse in the frequency range between approximately 1 Hertz and 1000 Hertz for each pulse to create a pulse amplitude between approximately 1 and 200 pounds per square inch at a distance of approximately one foot from the at least one pressurized gas-type pressure pulse shock wave source;
d. removing liquid from the heat exchanger at a rate between approximately 0.001 and 10 inches per minute while the shock wave sources are being generated until the level of liquid is below the lowermost tube support plate to be cleaned; and
e. continuously generating said shock waves for a period between approximately one hour to approximately twenty-four hours until the deposits have been loosened and removed from the surfaces of all of the tube support plates and the flow holes within each tube support plate so that all of the tube support plates and flow holes are clean.

17. In the art of removing corrosive deposits from locations within a heat exchanger in which the heat exchanger is characterized by an enclosed tank containing a plurality of heat exchanger tubes which are closely packed together and a plurality of support plates arranged transverse to and sequentially spaced along the longitudinal axis of the heat exchanger tubes and forming junctions therewith, where the support plates contain a multiplicity of transverse holes extending through their entire thickness and where crevices exist between the outer surface of the heat exchanger tubes and the support plates at the site of the junctions and wherein these crevices and the holes in the support plates act as flow holes to permit liquid which is placed in the enclosed tank to rise to a multiplicity of levels within the tank, the heat exchanger also containing an outer shell and a tube support sheet at the lower extremity of the tank to provide a base support for the multiplicity of heat exchanger tubes, the outer shell containing a multiplicity of openings known as hand holes adjacent the tube support sheet and another multiplicity of openings known as manways and additional hand holes located at various locations on the shell through which objects may be inserted into the heat exchanger, and further containing a metal wrapper inside the tank which envelopes the plurality of heat exchanger tubes and support plates and which is set above the tube support sheet to thereby provide a space between the metal wrapper and tube support sheet, wherein the region defined between the outer shell and all of the outer surfaces of all of the heat exchanger tubes is known as the secondary side, and wherein products of corrosion, oxidation and sedimentation tend to build up and form deposits on said tube support plates and further within the flow holes to thereby occlude one or more flow holes, on heat exchanger tubes, on the metal wrapper, on the internal wall of the external shell, and on other heat exchanger components, the process of removing the deposits from all of the heat exchanger components while the heat exchanger tubes, tube support plates and all other components remain in their operative position inside the heat exchanger, comprising the steps of:

a. selecting at least one pressurized gas-type pressure pulse shock wave source and placing the at least one pressurized gas-type pressure pulse shock wave source into the secondary side of said heat exchanger;
b. filling said heat exchanger with a liquid to a level just below the area of the components of the heat exchanger to be cleaned;
c. activating said at least one pressurized gas-type pressure pulse shock wave source to generate a series of repetitive shock waves which are generated with a source pressure between approximately 100 pounds per square inch and 5000 pounds per square inch which reach an energy pulse in the frequency range between approximately 1 Hertz and 1000 Hertz for each pulse to create a pulse amplitude between approximately 1 and 200 pounds per square inch at a distance of approximately one foot from the at least one pressurized gas-type pressure pulse shock wave source;
d. continuously generating said shock waves for a period between approximately one hour to approximately twenty-four hours until the deposits have been loosened and removed from said area of the components of the heat exchanger to be cleaned;
e. changing the water level to a level just below the next area of the components of the heat exchanger to be cleaned and continuing the generation of shock waves until the next support plate and flow holes therein are cleaned; and
f. continuing in this fashion at the level of each area of the components of the heat exchanger to be cleaned until all of said areas have been cleaned.

18. In the art of removing corrosive deposits from locations within a heat exchanger in which the heat exchanger is characterized by an enclosed tank containing a plurality of heat exchanger tubes which are closely packed together and a plurality of support plates arranged transverse to and sequentially spaced along the longitudinal axis of the heat exchanger tubes and forming junctions therewith, where the support plates contain a multiplicity of transverse holes extending through their entire thickness and where crevices exist between the outer surface of the heat exchanger tubes and the support plates at the site of the junctions and wherein these crevices and the holes in the support plates act as flow holes to permit liquid which is placed in the enclosed tank to rise to a multiplcity of levels within the tank, the heat exchanger also containing an outer shell and a tube support sheet at the lower extremity of the tank to provide a base support for the multiplicity of heat exchanger tubes, the outer shell containing a multiplicity of openings known as hand holes adjacent the tube support sheet and another multiplicity of openings known as manways and additional hand holes located at various locations on the shell through which objects may be inserted into the heat exchanger, and further containing a metal wrapper inside the tank which envelopes the plurality of heat exchanger tubes and support plates and which is set above the tube support sheet to thereby provide a space between the metal wrapper and tube support sheet, wherein the region defined between the outer shell and all of the outer surfaces of all of the heat exchanger tubes is known as the secondary side, and wherein products of corrosion, oxidation and sedimentation tend to build up and form deposits on said tube support plates and further within the flow holes to thereby occlude one or more flow holes, on heat exchanger tubes, on the metal wrapper, on the internal wall of the external shell, and on other heat exchanger components, the process of removing the deposits from all of the heat exchanger components while the heat exchanger tubes, tube support plates and all other components remain in their operative position inside the heat exchanger, comprising the steps of:

a. selecting at least one pressurized gas-type pressure pulse shock wave source and placing the at least one pressurized gas-type pressure pulse shock wave source into the secondary side of said heat exchanger;
b. filling the entire heat exchanger with a liquid;
c. activating said at least one pressurized gas-type pressure pulse shock wave source to generate a series of repetitive shock waves which are generated with a source pressure between approximately 100 pounds per square inch and 5000 pounds per square inch which result in an energy pulse in the frequency range between approximately 1 Hertz and 1000 Hertz for each pulse to create a pulse amplitude between approximately 1 and 200 pounds per square inch at a distance of approximately one foot from the at least one pressurized gas-type pressure pulse shock wave source; and
d. continuously generating said shock waves for a period between approximately one hour to approximately twenty-four hours until the deposits have been loosened and removed from said area of the components of the heat exchanger to be cleaned.

19. The invention as defined in claims 1, 2, 3, 4, 5, 6, 7, 8, 9, 10, 11, 12, 13, 14, 15, 16, 17, or 18 comprising the further step of circulating a liquid through the heat exchanger to flush and vacuum deposits from the heat exchanger and filtering the liquid to remove the deposits before the liquid is returned to the heat exchanger.

20. The invention as defined in claims 1, 2, 3, 4, 5, 6, 7, 8, 9, 10, 11, 12, 13, 14, 15, 16, 17, or 18 wherein cleaning chemicals are added to the liquid to increase cleaning effectiveness.

21. The invention as defined in claims 1, 2, 3, 4, 5, 6, 7, 8, 9, 10, 11, 12, 13, 14, 15, 16, 17, or 18 wherein said liquid is water.

22. The invention as defined in claims 1, 2, 3, 4, 5, 6, 7, 8, 9, 10, 11, 12, 13, 14, 15, 16, 17, or 18 wherein the type of heat exchanger being cleaned is a U-bend type heat exchanger.

23. The invention as defined in claims 1, 2, 3, 4, 5, 6, 7, 8, 9, 10, 11, 12, 13, 14, 15, 16, 17, or 18 wherein the type of heat exchanger being cleaned is a once through type heat exchanger.

24. The invention as defined in claims 1, 2, 3, 4, 5, 6, 7, 8, 9, 10, 11, 12, 13, 14, 15, 16, 17, or 18 wherein said heat exchanger is a nuclear reactor core barrel.

* * * * *